US005692248A

United States Patent [19]

Ball

[11] Patent Number: 5,692,248

[45] Date of Patent: Dec. 2, 1997

[54] MEANS FOR COVERING THE FLANGE OF A WASTE WATER STRAINER

[75] Inventor: William T. Ball, Leawood, Kans.

[73] Assignee: WCM Industries, Inc., Colorado Springs, Colo.

[21] Appl. No.: 704,419

[22] Filed: Aug. 20, 1996

Related U.S. Application Data

[63] Continuation-in-part of Ser. No. 599,291, Feb. 9, 1996.

[51] Int. Cl.[6] ..... A47K 1/14

[52] U.S. Cl. ..... 4/286

[58] Field of Search ..... 4/286, 287, 580; 241/41.013, 41.015, 41.016

[56] References Cited

U.S. PATENT DOCUMENTS

| | | | |
|---|---|---|---|
| 4,310,933 | 1/1982 | Stratman | 4/286 |
| 5,318,230 | 6/1994 | Ferguson et al. . | |
| 5,330,811 | 7/1994 | Buchalter . | |
| 5,418,983 | 5/1995 | Garguillo et al. | 4/287 |

*Primary Examiner*—Charles E. Phillips
*Attorney, Agent, or Firm*—Zarley, McKee, Thomte, Voorhees, & Sease

[57] ABSTRACT

A waste water insert has a cylindrical wall surrounding a vertical cylindrical bore. A horizontal flange extends outwardly from the upper end of the wall and has a lip formed on its outer periphery. The horizontal flange of the waste water insert is super-imposed over the horizontal flange of a conventional waste water strainer located in a bathtub, sink or the like. The lip at the outer perimeter of the flange of the insert fits over the outer periphery of the horizontal flange of the waste water strainer to center the insert on the strainer. The cylindrical wall of the insert extends downwardly through the conventional cylindrical wall of the waste water strainer with the two walls being spaced from each other by virtue of the cylindrical wall of the insert having a smaller diameter than that of the strainer. The conventional cylindrical wall of the strainer extends below the cylindrical wall of the insert, and has a lower circular edge. One or more spring clip elements having upturned ends are suspended from the cylindrical wall of the insert, with the upturned ends abutting the lower circular edge of the conventional strainer cylindrical wall.

5 Claims, 2 Drawing Sheets

MEANS FOR COVERING THE FLANGE OF A WASTE WATER STRAINER

CROSS-REFERENCE TO A RELATED APPLICATION

This application is a continuation-in-part application of U.S. Ser. No. 08/599.291 filed Feb. 9, 1996.

BACKGROUND OF THE INVENTION

A strainer in the plumbing field is the threaded fitting in the bottom of a sink, bathtub, or the like through which waste water flows from the receptacle. Strainers usually have valves or the like which control the gravity flow of water therethrough. All of these valve assemblies are threadably mounted within a threaded aperture located in the strainer.

Existing strainers have a vertically disposed externally threaded sleeve which engage corresponding threads on a fitting adjacent a vertically disposed aperture in the bottom of the water receptacle. The upper end of the sleeve terminates in a circular horizontal flange which engages and is sealed to the bottom of the receptacle around the aperture in the bottom of the receptacle. A hub with a threaded bore and with radially extending spokes is often located in a horizontal plane in the bottom of the strainer to support various closure valves.

It is occasionally necessary to change the strainer of a given receptacle because the flange thereof has become tarnished, disfigured, or because the flange is incompatible esthetically with the owner's sense of ornamentation. Removal of the strainer is often a difficult task, particularly when the strainer has been in place for a long time. Conventional tools are typically insufficient for use in removal of the strainer. Further, there is a possibility that the threads of the replacement strainer will not be compatible with the threads of the fitting or bushing associated with the aperture of the receptacle.

Some attempts have been made to place a substitute flange over the existing flange by providing structure whereby the substitute flange can be threadably secured to threaded bores of the strainer which originally threadably received the valve assembly of the strainer. This approach to the installation of a substitute flange is not satisfactory because variations of thread sizes in the original strainers are often incompatible with the thread sizes of the substituted flange adapter.

It is therefore a principal object of this invention to provide a means for covering the flange of an existing strainer without removing the existing strainer.

A further object of this invention is to provide a means for covering the flange of an existing strainer which will permit easy installation, and which will be well within the ability of those not being skilled in the plumbing art.

These and other objects will be apparent to those skilled in the art.

SUMMARY OF THE INVENTION

A waste water insert has a cylindrical wall surrounding a vertical cylindrical bore. A horizontal flange extends outwardly from the upper end of the wall and has a lip formed on its outer periphery.

The horizontal flange of the waste water insert is superimposed over the horizontal flange of a conventional waste water strainer located in a bathtub, sink or the like. The lip at the outer perimeter of the flange of the insert fits over the outer periphery of the horizontal flange of the waste water strainer to center the insert on the strainer. The cylindrical wall of the insert extends downwardly through the conventional cylindrical wall of the waste water strainer with the two walls being spaced from each other by virtue of the cylindrical wall of the insert having a smaller diameter than that of the strainer. The conventional cylindrical wall of the strainer extends below the cylindrical wall of the insert, and has a lower circular edge. One or more spring clip elements having upturned ends are suspended from the cylindrical wall of the insert, with the upturned ends abutting the lower circular edge of the conventional strainer cylindrical wall.

DESCRIPTION OF THE PREFERRED EMBODIMENT

Figure 1:
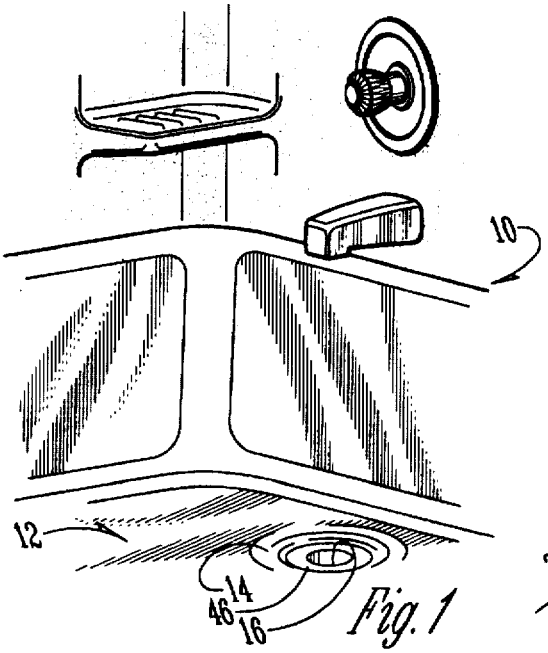
FIG. 1 is a partial perspective view of a conventional bathtub with a conventional waste water strainer located in the bottom thereof.

The numeral 10 designates a conventional fluid compartment or receptacle such as a tub or a sink. Compartment 10 has a bottom 12 with an interior bottom surface 14. A waste water aperture 16 (FIG. 3) is located in bottom 12 and a conventional shoulder 18 (FIG. 3) surrounds the lower portion of the aperture 16.

Figure 3:
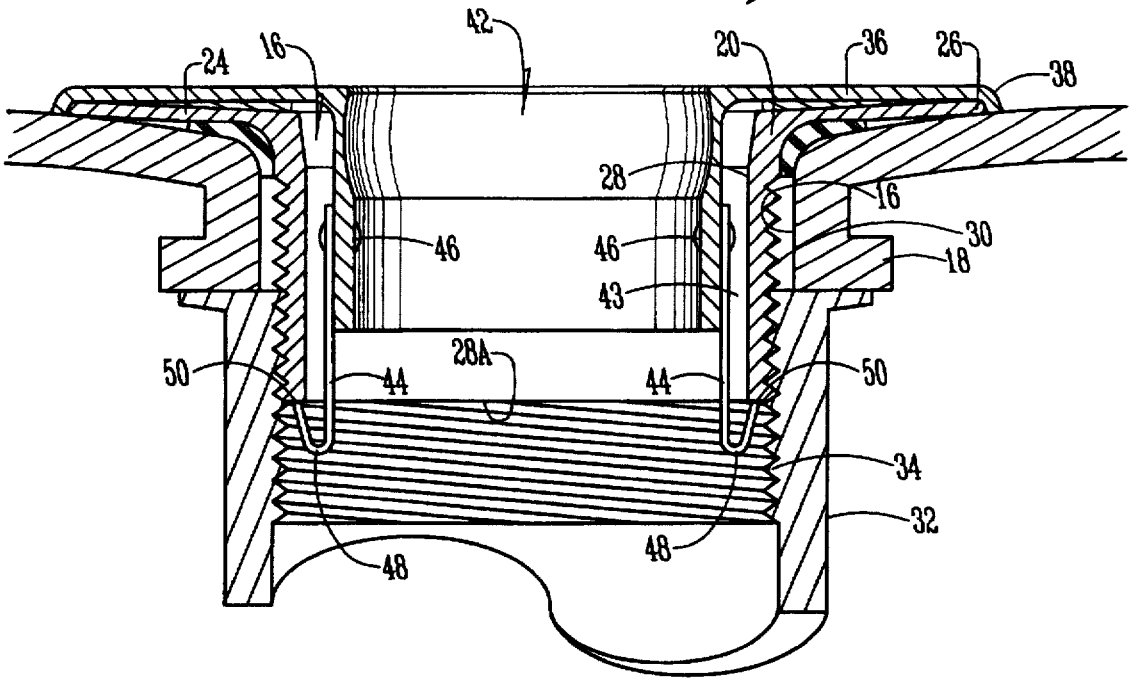
FIG. 3 is an enlarged scale sectional view taken on line 3—3 of FIG. 2 when the insert is assembled on the strainer.

A conventional waste water strainer 20 is shown in FIG. 3. Strainer 20 has an upper end 22 from which a horizontal circular flange 24 extends. The outer perimeter 26 of flange 24 engages the interior bottom surface 14 surround aperture 16. The strainer 20 has a downwardly extending cylindrical wall 28 (FIG. 3) and external threads 30.

With reference to FIG. 3, a bushing 32 has internal threads 34 threadably engaging external threads 30 on strainer 20. By tightening bushing 32 against the bottom of shoulder 18, the strainer 20 is pulled into tight engagement with the bottom 12 of compartment 10.

The foregoing structure is conventional and does not of itself constitute the instant invention. The typical closure valves which may be associated with conventional strainer 20 have not been shown.

The numeral 34 designates the first embodiment of the waste water insert of this invention. Insert 34 has a horizontal flange 36 with the periphery thereof terminating in a downwardly extending lip 38. As best shown in FIG. 3, the lip 38 extends downwardly and over the outer perimeter 26 of flange 24 of strainer 20. The lip 38 tightly engages the bottom 12 of compartment 10 when installed as will be discussed hereafter.

Figure 4:
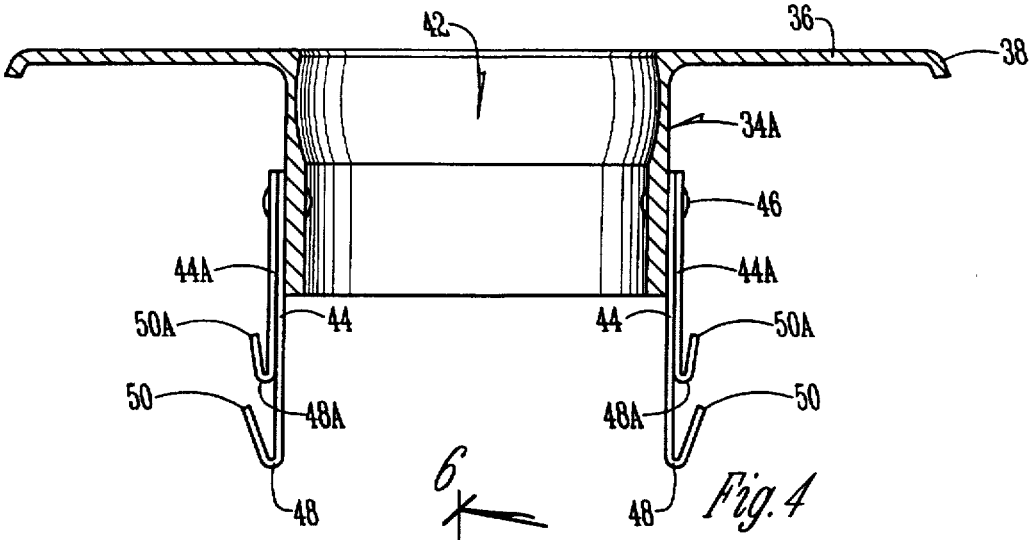
FIG. 4 is an enlarged scale sectional view similar to that of FIG. 3 showing a modified form of insert.

Insert 34 has a downwardly extending wall 40 which surrounds a center opening 42. The diameter of cylindrical wall 40 is less than the diameter of the cylindrical wall 28 of strainer 20 so that a space 43 (FIGS. 3 and 4) exists between the two walls. The lip 38 on the outer perimeter of the flange 24 of insert 34 centers the cylindrical wall 40 within the cylindrical wall 28 of strainer 20 (FIG. 3). A pair of longitudinal spring clips 44 are secured by rivets 46 to wall 40 at their upper ends. The lower ends thereof terminate in an upstanding U-shaped portion 48 having an upper and inwardly located free edge 50. As shown in FIG. 3, edges 50 are adapted to engage the lower edge 28A of cylindrical wall 28 to hold the insert 34 in place. Spring clips 44 may be deflected as required when insert 34 is moved downwardly to the position of FIG. 3 within strainer 20.

Figure 2:
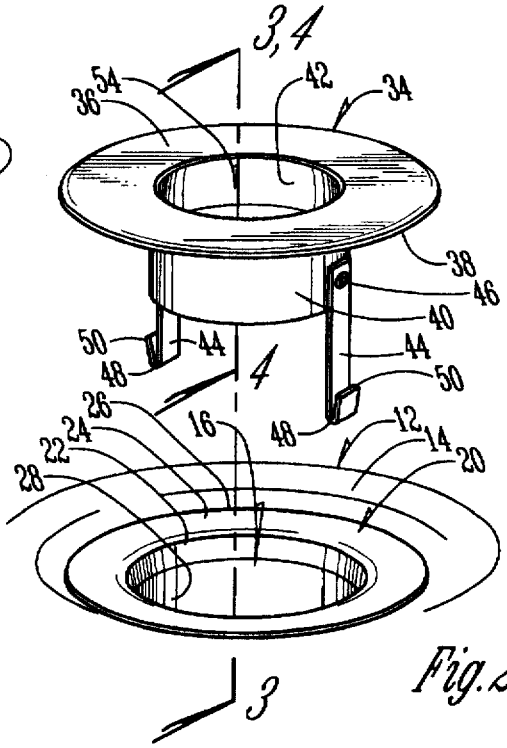
FIG. 2 is an exploded view showing a preliminary step in mounting the waste water insert onto the existing waste water strainer.

The embodiment of insert 34A (FIG. 4) is identical to that of FIGS. 2 and 3 except that a second spring clip 44A of shorter length is imposed over clips 44 to accommodate strainers that have a shorter vertical length than strainer 28. The members 48A and 50A correspond exactly to members 48 and 50, respectively.

Figure 5:
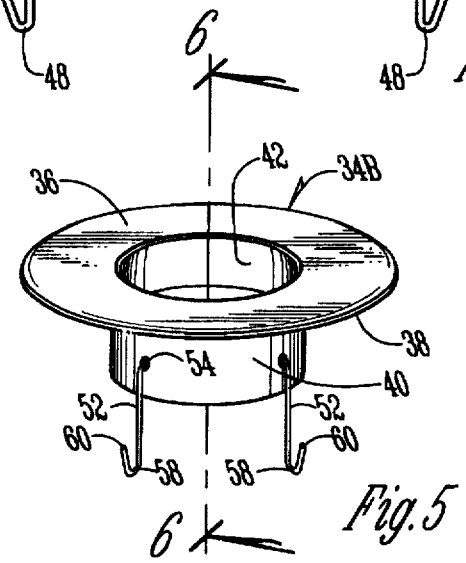
FIG. 5 is a perspective view of a further modified form of the invention.
Figure 6:
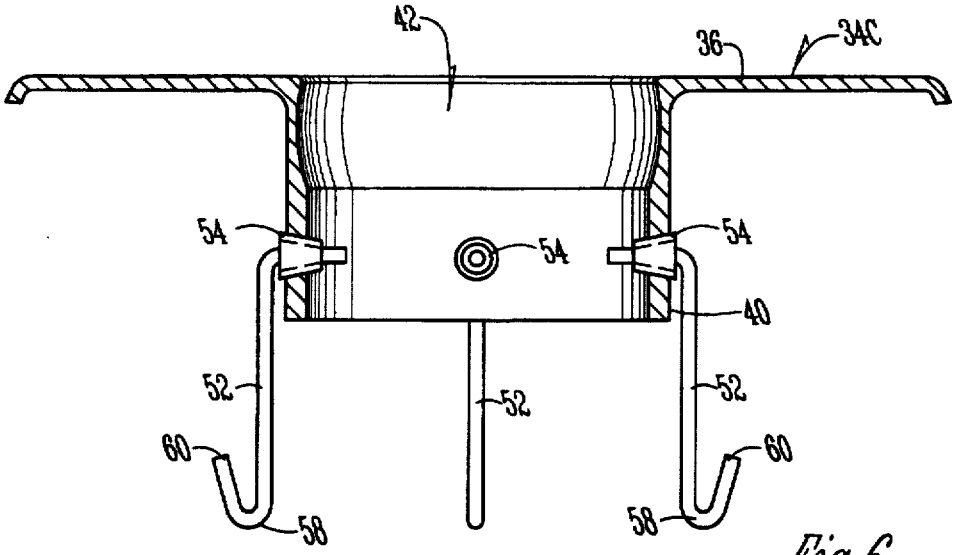
FIG. 6 is an enlarged scale sectional view taken on line 6—6 of FIG. 5.

The embodiment of FIGS. 5 and 6 show insert 34B which is the same as that of insert 34 except that wire hooks 52 are secured at the upper ends to wall 40 by ferrules 54 fitting in apertures of the wall 40. The lower ends of hooks 52 have U-shaped portions 58 with upstanding ends 60 which engage the lower end 28A of wall 28 just as did the spring clips 44 of FIG. 1.

All the embodiments of inserts are installed by moving them downwardly into the opening 16 through strainer 20 until the U-shaped portions on the lower ends of member 44 (FIGS. 2–4); 44A (FIG. 4); or hooks 52 (FIGS. 5 and 6) spring outwardly into engagement with the lower end 28A of wall 28 of strainer 20. No tools are required, and the inserts are quickly, easily, and securely installed to achieve their required purpose.

What is claimed is:

1. In combination with a fluid compartment having a bottom with a waste water strainer mounted in said bottom, said strainer having a cylindrical wall with a bottom horizontal edge surrounding a vertical cylindrical opening extending through the bottom of said compartment, and a horizontal flange extending outwardly from a level above and adjacent said cylindrical opening and positioned on the bottom of said compartment, a waste water insert comprising a cylindrical wall surrounding a vertical cylindrical bore and having an upper end, and a horizontal flange on said upper end extending outwardly from said cylindrical bore, the horizontal flange on said insert resting on the horizontal flange of said strainer, and the cylindrical wall of said insert being of a smaller diameter than the diameter of the cylindrical wall of said strainer and extending downwardly into the cylindrical opening of said strainer, the cylindrical wall of said insert being free from engagement with the cylindrical wall of said strainer, spring clips secured to the cylindrical wall of said insert and having lower ends terminating in an upstanding portion in engagement with the bottom horizontal edge of the cylindrical wall of said strainer.

2. The combination of claim 1 wherein said spring clip have a second upstanding portion positioned vertically above said first mentioned upstanding portion to permit engagement therewith of the bottom edge of vertically shorter strainer.

3. The combination of claim 1 wherein said spring clips are composed of bent wires.

4. The combination of claim 1 wherein said upstanding portion extends inwardly towards the center of said insert.

5. In combination with a fluid compartment having a bottom with a waste water strainer mounted in said bottom, said strainer having a cylindrical wall with a bottom horizontal edge surrounding a vertical cylindrical opening extending through the bottom of said compartment, and a horizontal flange extending outwardly from a level above and adjacent said cylindrical opening and positioned on the bottom of said compartment, a waste water insert comprising a cylindrical wall surrounding a vertical cylindrical bore and having an upper end, and a horizontal flange on said upper end extending outwardly from said cylindrical bore, the horizontal flange on said insert resting on the horizontal flange of said strainer, and the cylindrical wall of said insert being of a smaller diameter than the diameter of the cylindrical wall of said strainer and extending downwardly into the cylindrical opening of said strainer, the cylindrical wall of said insert being free from engagement with the cylindrical wall of said strainer, spring clips secured to the cylindrical wall of said insert and having lower ends gripping the bottom horizontal edge of the cylindrical wall of said strainer.

* * * * *